United States Patent [19]

Stirrat et al.

[11] 4,158,323

[45] Jun. 19, 1979

[54] TRAINING FLARE DISPENSING SYSTEM

[75] Inventors: William M. Stirrat, Sparta; Donald H. Brandt, Wayne, both of N.J.

[73] Assignee: The United States of America as represented by the Secretary of the Army, Washington, D.C.

[21] Appl. No.: 872,856

[22] Filed: Jan. 27, 1978

[51] Int. Cl.[2] ..... F41F 5/00

[52] U.S. Cl. ..... 89/1.5 R; 102/35.2; 102/37.4

[58] Field of Search ..... 89/1.5 R, 1.5 C, 1 L, 89/1 R; 102/37.4, 37.1, 35.6, 35.2

[56] References Cited

U.S. PATENT DOCUMENTS

| | | | |
|---|---|---|---|
| 1,781,621 | 11/1930 | Wiley | 89/1.5 R |
| 1,937,191 | 11/1933 | Driggs | 102/35.2 X |
| 1,937,219 | 11/1933 | Driggs | 102/35.2 X |
| 1,937,220 | 11/1933 | Driggs | 89/1.5 R |
| 2,381,130 | 8/1945 | Lloyd | 89/1 R |
| 3,628,416 | 12/1971 | Kernan | 102/37.4 X |
| 3,724,817 | 4/1973 | Simons | 89/1.5 R X |

*Primary Examiner*—David H. Brown

*Attorney, Agent, or Firm*—Nathan Edelberg; A. Victor Erkkila; Max Yarmovsky

[57] ABSTRACT

A system for safely simulating artillery delivered flare illumination over troops engaged in nighttime tactical training exercises, utilizes a lifting device for carrying a tethered electrically initiated, gravity released flare dispenser system to provide illumination over a target area while substantially reducing the hazard to personnel of flare debris fallout and malfunction danger to the lifting device. A tubularly shaped flare dispenser housing member supports a plurality of reloadable cylindrically shaped parachute flare assemblies. An electrically operated parachute flare initiator is utilized to simultaneously ignite and drop-release one or more combustible case flares by severing a burn-through cord retaining member.

5 Claims, 7 Drawing Figures

TRAINING FLARE DISPENSING SYSTEM

GOVERNMENTAL INTEREST

The invention described herein may be manufactured, used and licensed by or for the Government for governmental purposes without the payment to me of any royalty thereon.

BACKGROUND OF THE INVENTION

Various means have been used in the past to deliver illumination over a target area. The problems associated with prior art flare delivery devices, such as those carried by artillery fired projectiles, rockets and or aircraft, has been the difficulty of obtaining accuracy of flare placement, danger to the carrying aircraft from a malfunction in the dispenser, and freedom from flare debris fallout once deployed over the target area. Prior art devices generally employ heavy metal containers in order to launch and contain the flare. The use of high strength dense materials in the prior art devices were necessary to provide the strength necessary to preserve the structural integrity of the device so that it could function after being subjected to acceleration and vibrational forces encountered as a result of setback and spin during launch, and shock and vibrational forces encountered during transportation. Another problem with the prior art devices has been the danger caused by falling debris to ground deployed personnel because of malfunctions in the projectile delivery vehicle and improper arming of the projectile or rocket launch weapon.

PRIOR ART STATEMENT

The applicant has reviewed the following patents and found them of interest and pertinent to the present application;

U.S. Pat. No.: 1,937,219

U.S. Pat. No.: 1,937,220

U.S. Pat. No.: 2,381,130

U.S. Pat. No. 1,937,219 of L. L. Driggs, Jr., discloses a flare supporting and firing device which is initiated by an electrical means but may be distinguished from the present invention in that the dispenser is fixedly attached to the carrying aircraft as against being tethered a safe distance therefrom. Driggs uses a plug and powder charge to expell the flare from the dispenser rather than a drop release means.

U.S. Pat. No. 1,937,220 is similar to U.S. Pat. No. 1,927,219 and may be further distinguished from the present invention in that it requires a metal closure cap to retain the flare therein. The metal cap closure disclosed in this reference contributes to flare debris fallout whereas there is negligible fallout from the present invention.

U.S. Pat. No. 2,381,130 of M. W. Lloyd discloses a single tethered active flare carried and retained by an aircraft after being mechanically activated and may be distinguished from the present invention which discloses an inert flare dispenser which releases a plurality of flares after electrical initiation.

SUMMARY OF THE INVENTION

The present invention relates to a training flare dispensing system utilizing a tethered tubularly shaped flare dispenser housing for releasably holding a plurality of parachute flare assemblies which are simultaneously electrically ignited and gravity drop released by the severance of a burn-through retaining element.

An object of the present invention is to provide a system for safely simulating artillery delivered flare illumination over troops engaged in nighttime tactical training exercises without subjecting troop personnel to flare or projectile debris fallout.

Another object of the present invention is to provide a tethered apparatus suitable for flare delivery which reduces flare debris fallout and insures the safety of a delivery vehicle from malfunction of the flare dispensing system.

Another object of the present invention is to provide a training flare dispensing system which will insure accurate placement of one or more flares at a point in space above a target area having substantially no debris fallout from either the flare or the dispensing device.

Another object of the present invention is to provide a training flare dispenser wherein the release of the parachute flare by a burn-through member and the initiation of the flare are simultaneously activated by the same electrically initiated member.

A further object of the present invention is to provide a training flare dispensing device which can be sling-loaded from a lifting means and electrically operated therefrom to provide a means for dispensing single parachute flares in sequence or as a salvo of a plurality of flares as may desired.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
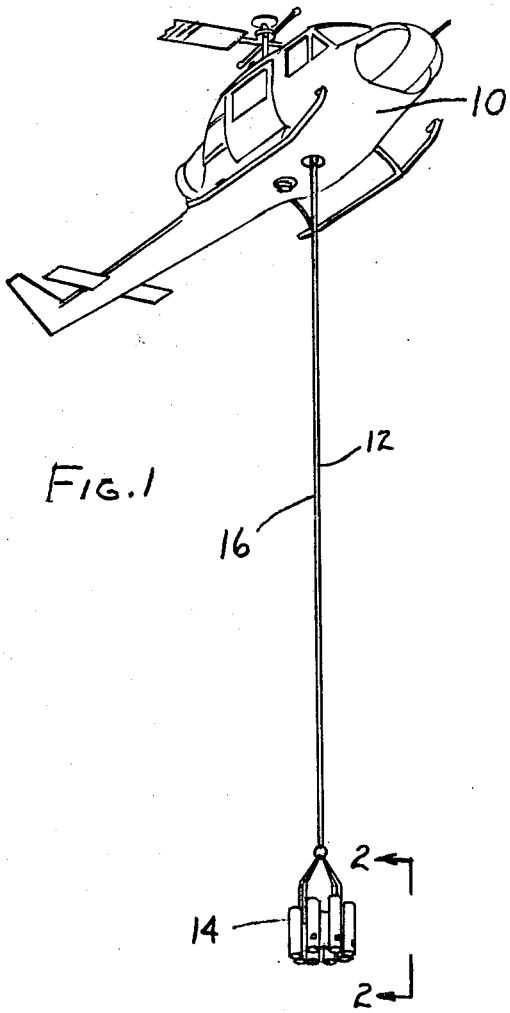
FIG. 1 is an isometric view showing a helicopter with a sling-loaded training flare dispenser device suspended therefrom.
Figure 3:
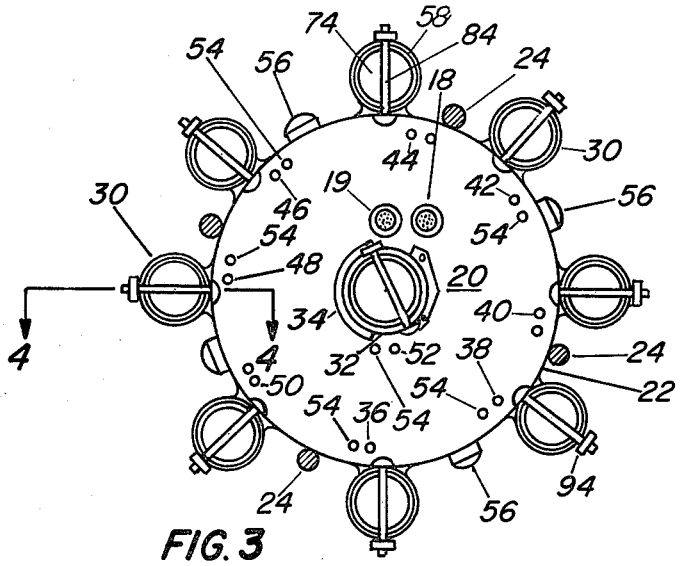
FIG. 3 is a top view of the training flare dispenser assembly taken along line 3—3 of FIG. 2.
Figure 2:
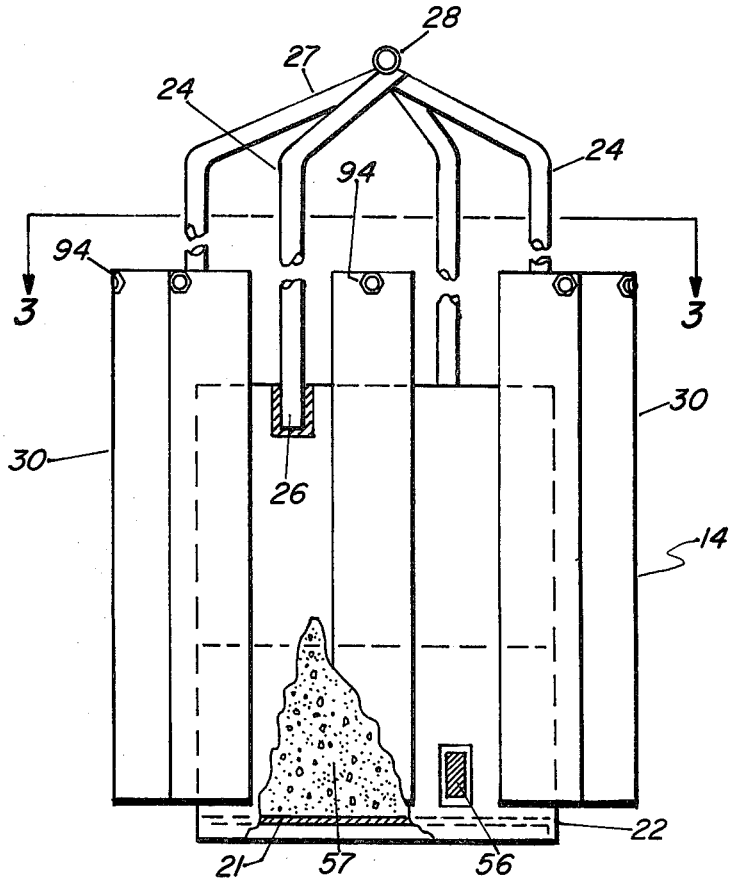
FIG. 2 is an elevational view of the training flare dispenser assembly taken along line 2—2 of FIG. 1.

Referring now to FIGS. 1–3 a helicopter 10 uses a wire rope 12 tied to its underneath side to mechanically support and lift a training flare dispenser assembly 14 over troops located in a target area. An electrical power control cable 16 attached to wire rope 12 connects a control instrument, located in the helicopter lifting means 10 and to be discussed in detail hereinafter, to a multi-element pin connector 18 located on top cover 20 of tubularly shaped housing 22. Housing 22 has a pair of "U" shaped support rods 24 welded at their free ends 26 to the outer peripheral edge of housing 22. Support rods 24 are joined together at their top ends by a lifting loop 28. A plurality of dispenser holding tubes 30 equally spaced and welded to the circumference of housing 22 in parallel alignment with each other and with the longitudinal axis of the housing 22. A center dispenser holding tube 32 is slidably axially located in a central hole in top and bottom covers 20 and 21 of housing 22. Tube 32 is not welded to top cover 20 or bottom cover 21 but rather held on top cover 20 by a flange 34 which is fixedly attached to tube 32. Removal of tube 32 permits access to wiring interconnections between the pins of connector 18 and the push to open terminals 36–52 and common ground terminals 54 adjacent thereto. A plurality of dispenser running lights 56 are peripherally disposed in the lower end of housing 22 intermediate holding tubes 30 as a warning to other aircraft in the vicinity of the air space of the sling-supported dispenser 14. Ballast material 57 is operatively positioned in the lower end of tubular housing 22 to prevent undue swing away from the vertical during transport.

Figure 4:
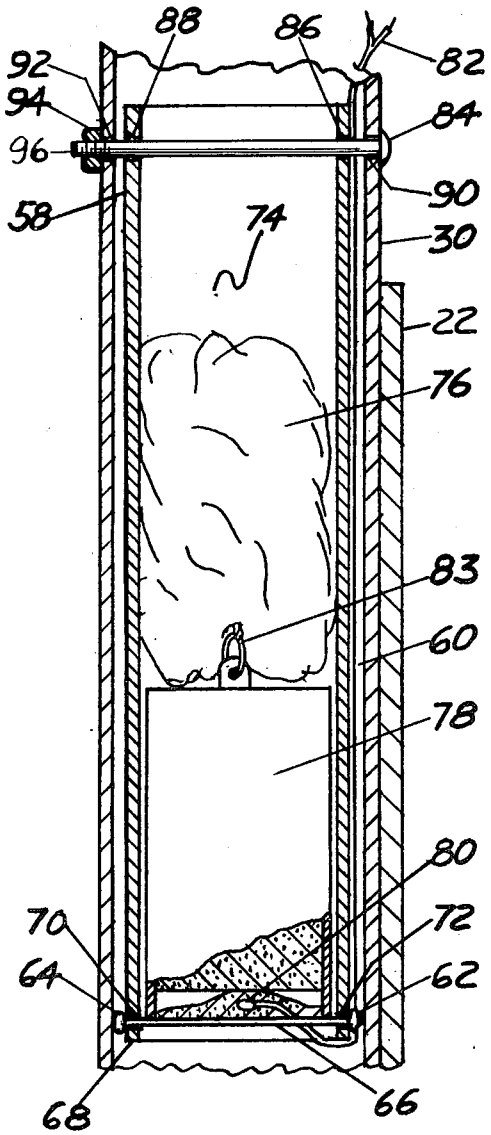
FIG. 4 is a partial cross-sectional view of a tubular parachute flare cartridge assembly taken along line 4—4 of FIG. 3.

Referring now to FIGS. 3 and 4, a tubularly shaped cartridge case 58 is slidably disposed in each holding tube 30 with sufficient clearance space 60 therebetween to permit the knotted ends 62 and 64 of nylon burn-through cord 66 to slidably pass therethrough. Nylon burn-through cord 66 is diametrically disposed across the bottom end 68 of cartridge case 58 and passes through a pair of axially aligned cord bore holes 70 and 72. Cartridge case parachute flare assembly 74 which is comprised of cartridge case 58, parachute 76, candle 78, flare igniter 80 and igniter cable 82 is fixedly held within holding tube 30 by a locking bolt 84 which diametrically passes through a pair of axially aligned cartridge case bolt holes 86 and 88 located in an upper end, and holding tube bolt holes 90 and 92 located in the top end of holding tube 30. The parachute flare assembly comprising a parachute 76, a candle 78, parachute to candle tether, and flare igniter 80 are each made entirely of combustible materials in order to prevent debris fallout. A nut 94 is screwed on bolt threaded end 96 to permit the easy removal thereof and the reloading of holding tube 30 with a new parachute flare assembly 74 after dispensing of the flares over the target area.

Figure 5:
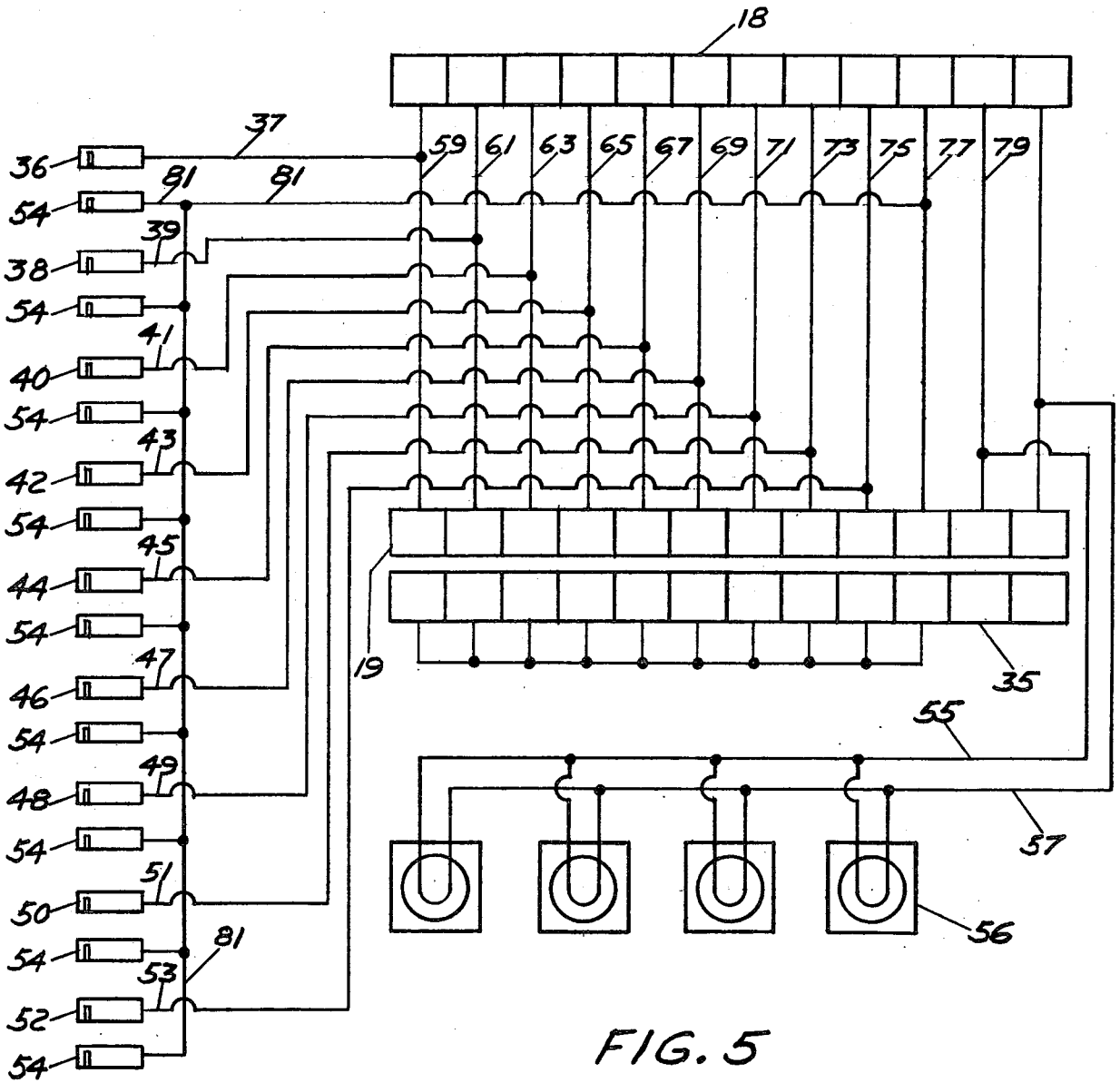
FIG. 5 is an electrical wiring diagram for the dispenser shown in FIGS. 2 and 3.

Referring now to FIGS. 3 and 5, push to open terminals 36–52 are electrically connected to a first multi-pin connector receptacle 18 via odd numbered electrical conductors 37–53. A plurality of dispenser running lights 56 are electrically connected in parallel through electrical conductors 55 and 57 to the first multi-element pin connector 18. A second multi-element pin connector terminal 19 is electrically coupled in parallel with terminal connector 18 by odd numbered electrical conductors 59–79. Common ground terminals 54 are electrically connected to the first multi-pin connector 18 via electrical conductor 81. A shorting-out plug 35 is inserted into the second multi-element pin connector 19 while the flare dispenser assembly 14 is being loaded, in order to prevent accidental initiation of the flare igniter 80 by the application of a power source to the terminals of the first multi-pin connector 18 or by pickup of random radio frequency radiations.

Figure 6:
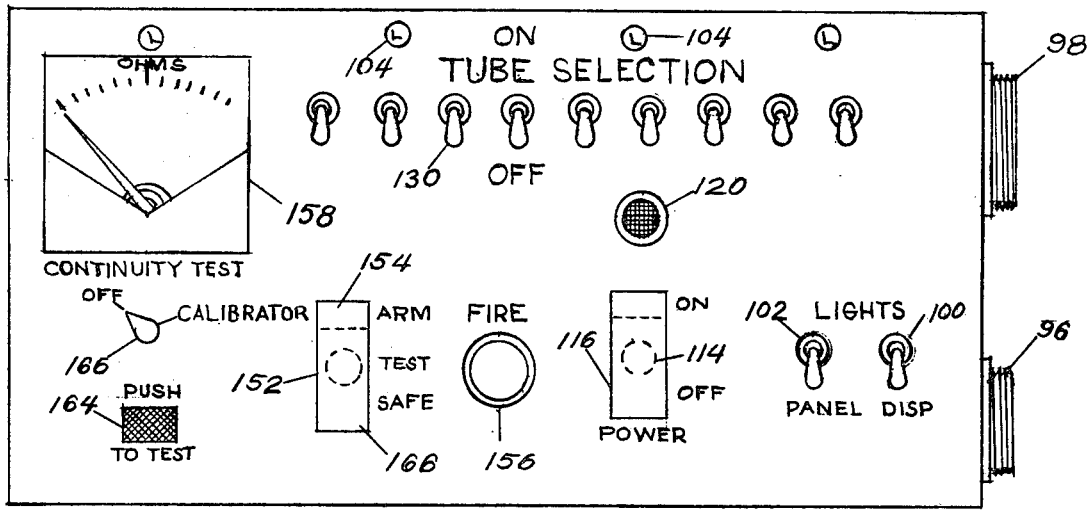
FIG. 6 is a plan view of a control panel of an instrument, carried by the lifting means, which is utilized to safe, arm and initiate the flare and resulting dispensing of the parachute flares.
Figure 7:
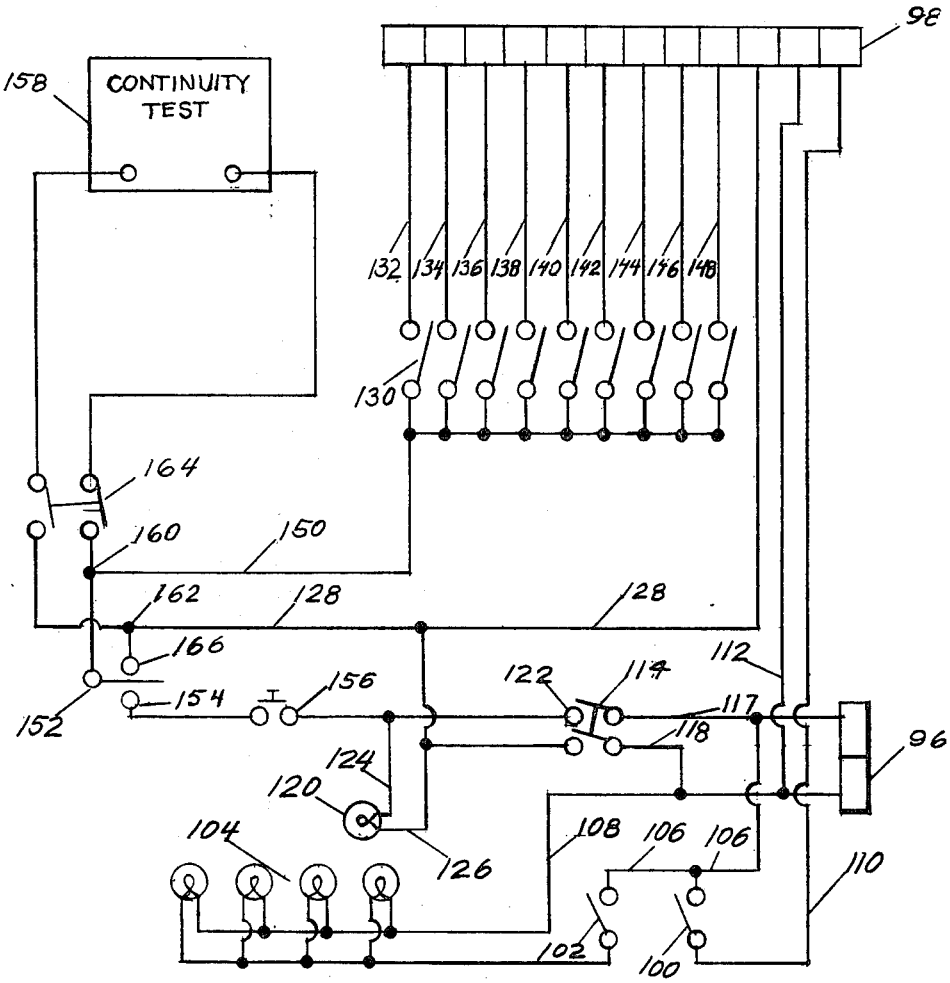
FIG. 7 is an electrical schematic of the control instrument panel shown in FIG. 6.

Referring now to FIGS. 6 and 7 the control instrument has an input connector terminal 96 and a multi-terminal output connector 98. The output of the control instrument from output connector 98 is electrically coupled to the input connector 18, disposed on the flare dispenser assembly, by means of control power cable 16. Dispenser and panel light single pole single throw toggle switches 100 and 102 respectively are electrically connected in series with parallel connected panel lights 104 and dispenser running lights 56 via electrical conductors 106, 108 and 106, 110, 112 respectively. A double pole single throw power switch 114 with protective cover 116 is electrically connected to input connector 96 via electrical conductors 117 and 118. A power-on light 120 is electrically coupled in parallel with power switch output terminals 122 via electrical conductors 124 and 126. The plurality of flare igniters 80 are electrically coupled in parallel to power output switch terminals 122 through electrical conductors 128, and 77 and 81 shown in FIG. 5, through the series connected selection single pole single throw switches 130 via conductors 132–148 and 150 when selector switches 130 are placed in their closed position, when the single pole double throw normally open safe/arm switch 152 is switched to the arm terminal 154, and when the single pole manually controlled normally open series connected push button fire switch 156 is depressed. A check of the igniter-control circuit continuity is performed with a continuity tester 158 which measures the resistance of the circuit and is electrically connected to the igniter circuit at junction points 160 and 162 by a double pole single throw normally open push button test switch 164. When the cover 152 of the safe/arm switch 152 is in the closed position the switch 152 will make contact with the "safe" terminal 166 causing the igniter circuit to be open circuited.

In operation a helicopter 10, or a lifting means such as a dirigible, ballon or a crane, transports the flare dispenser assembly 14 to the target area. After the operator of the control instrument shown in FIG. 6 has performed a continuity check to assure that the igniter circuits are operable, the continuity tester function knob 166 is moved by the operator to the "Off" position. The power switch 114 is turned "On" and the safe/arm switch 152 is placed in "arm" position 154. The selector switches 130 are closed placing the igniters of the flare assemblies to be fired in an "On" position. When the fire switch 156 is depressed, voltage is supplied to those igniter circuits having had selector switch 130 closed, causing flare igniter 80 to ignite candle 78 and simultaneously sever burn-through cord 66 thus allowing the initiated parachute flare members to drop out of cartridge cases 58 and to accurately illuminate the desired target area without significant debris fall out.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. A flare lighting system for safely simulating artillery delivered parachute flares assemblies over a target area containing troops engaged in nighttime tactical training exercise which comprises:

lifting means for carrying said parachute flare assemblies to said target area and for electrically initiating said parachute flare assemblies when positioned over said target area;

tethering means adapted for supporting said parachute flare assemblies a safe distance from said lifting means;

housing means for releaseably holding a plurality of said parachute flare assemblies therein during loading and transport to said target area;

electrical power cable means for electrically coupling said lifting means to said housing means;

electrical control means operatively disposed in said lifting means for determining electrical continuity between said lifting means and said parachute flare assemblies and for providing electrical switching means for safing, arming and initiating said parachute flare assemblies over said target area.

2. A flare lighting system as recited in claim 1 wherein said lifting means comprises a helicopter.

3. A flare lighting system as recited in claim 2 wherein said housing means comprises:

a tubularly shaped housing having a longitudinal axis, a top cover partially closing one end and a bottom cover fixed to the other end;

a pair of "U" shaped support rods, having free ends welded to the outer peripheral edge of said housing, and joined together at their top ends by a lifting loop;

a plurality of dispenser holding tubes welded to the circumference of said housing in parallel alignment with each other and with the longitudinal axis of said housing, said holding tubes having diametrically disposed tube bolt holes disposed on a top end;

a plurality of dispenser housing running lights peripherally disposed in the lower end of said housing intermediate said dispenser holding tubes;

ballast material operatively positioned in the lower end of said tubular housing;

a plurality of tubularly shaped cartridge cases slidably disposed in each of said plurality of holding tubes, each of said cartridge cases having said parachute flare assemblies operatively disposed therein, said cartridge cases and said holding tubes having sliding clearance space therebetween, said cartridge cases having a pair of axially aligned cartridge case bolt holes located in an upper end and a pair of axially aligned cord bore holes located in a bottom end;

a locking bolt having a nut threadedly fixed on one end thereof, slidably disposed through said tube bolt holes and through said cartridge case bolt holes permits easy reloading of said cartridge cases; and a burn-through cord operatively disposed in said cord bore holes, said cord having knots on the ends thereof positioned in said sliding clearance space intermediate said cartridge case and said holding tube, said burn-through cord retaining said parachute flare assemblies in said cartridge cases while said parachute flare assemblies are being transported to said target area, and simultaneously releasing said parachute flare assemblies over said target area when said parachute flare assemblies are initiated by said electrical control means.

4. A flare lighting system as recited in claim 3 wherein said electrical control means comprises:

a continuity test set electrically coupled to said parachute flare assemblies; and switching means electrically coupled to said continuity test set to said dispenser housing running lights and to said parachute flare assemblies adapted to provide electrical continuity checking of said power cable means to said housing means, for setting said parachute flare assemblies to a "safe" or "arm" position, and for individually initiating or initiating a plurality of combinations of said parachute flares as desired by an operator located in said lifting means.

5. A flare lighting system as recited in claim 4 wherein each of said parachute flare assemblies comprises:

a parachute disposed in each of said cartridge cases;

a candle disposed beneath said parachute;

a parachute-to-candle tether fixedly attached to said parachute and said candle for supporting said candle from said parachute; and an electrical flare igniter proximately positioned intermediate said burn-through cord and said candle; said parachute, candle and flare igniter each being made of a combustible material.

* * * * *